US012798836B2

(12) United States Patent
Kittleson

(10) Patent No.: US 12,798,836 B2
(45) Date of Patent: Nov. 17, 2026

(54) CLOSURE WITH TAMPER-EVIDENT BAND

(71) Applicant: Closure Systems International Inc., Indianapolis, IN (US)

(72) Inventor: Alex E. Kittleson, West Lafayette, IN (US)

(73) Assignee: CLOSURE SYSTEMS INTERNATIONAL INC., Indianapolis, IN (US)

( * ) Notice: Subject to any disclaimer, the term of this patent is extended or adjusted under 35 U.S.C. 154(b) by 0 days.

(21) Appl. No.: 19/040,026

(22) Filed: Jan. 29, 2025

(65) Prior Publication Data

US 2025/0242977 A1 Jul. 31, 2025

Related U.S. Application Data

(60) Provisional application No. 63/627,617, filed on Jan. 31, 2024.

(51) Int. Cl.
*B65D 41/34* (2006.01)

(52) U.S. Cl.
CPC ..... *B65D 41/3442* (2013.01); *B65D 2401/20* (2020.05)

(58) Field of Classification Search
CPC ..... B65D 41/3442; B65D 2401/20; B65D 41/0414; B65D 41/3428
USPC ..... 215/252
See application file for complete search history.

(56) References Cited

U.S. PATENT DOCUMENTS

| | | | |
|---|---|---|---|
| 99,795 | A | 2/1870 | Stewart |
| 349,336 | A | 9/1886 | Borgfeldt |
| 2,124,873 | A | 7/1938 | Conner |
| 3,901,403 | A | 8/1975 | Menke |
| 4,157,144 | A | 6/1979 | Weiler |
| 4,166,552 | A | 9/1979 | Faulstich |
| 4,305,516 | A | 12/1981 | Perne |
| 4,326,639 | A | 4/1982 | Stahl |

(Continued)

FOREIGN PATENT DOCUMENTS

| | | | |
|---|---|---|---|
| CA | 2947922 | A1 | 11/2015 |
| DE | 29706672 | U1 | 6/1997 |

(Continued)

OTHER PUBLICATIONS

U.S. Appl. No. 29/755,890, now allowed, filed Oct. 23, 2020, Rishi Deshpande, Closure With Tamper-Evident Band.

(Continued)

*Primary Examiner* — James N Smalley
(74) *Attorney, Agent, or Firm* — NIXON PEABODY LLP

(57) ABSTRACT

A closure includes first and second closure portions. The first closure portion includes a top wall portion and an annular skirt portion. The skirt portion includes an internal thread formation. The second closure portion includes a tamper-evident band depending from and being at least partially detachably connected to the skirt portion by a frangible connection. The polymeric tamper-evident band includes a first portion and a second portion connected via a bending area. The first portion has a flared end in which the thickness of the flared end is at least 1.25 times greater than the thickness of a directly adjacent section of the first portion. The second portion has a tab portion and an extension portion.

20 Claims, 8 Drawing Sheets

(56) References Cited

U.S. PATENT DOCUMENTS 4,346,811 A 8/1982 Hilaire
4,394,918 A 7/1983 Grussen
4,402,418 A 9/1983 Ostrowsky
4,450,100 A 5/1984 Kano
4,458,821 A 7/1984 Ostrowsky
4,470,513 A 9/1984 Ostrowsky
4,478,343 A 10/1984 Ostrowsky
4,485,934 A 12/1984 Maguire
4,506,795 A 3/1985 Herr
4,534,479 A 8/1985 Conti
4,546,892 A 10/1985 Couput
4,550,844 A 11/1985 Lininger
4,562,931 A 1/1986 Brach
4,592,475 A 6/1986 Hannon
4,593,830 A 6/1986 Bullock
4,595,110 A 6/1986 Herr
4,613,052 A 9/1986 Gregory
4,643,321 A 2/1987 Gach
4,657,153 A 4/1987 Hayes
4,664,278 A 5/1987 Barriac
4,667,838 A 5/1987 Yeager
4,667,839 A 5/1987 Crisci
4,694,970 A 9/1987 Hayes
4,699,290 A 10/1987 Adams
4,801,030 A 1/1989 Barriac
4,807,770 A 2/1989 Barriac
4,807,771 A 2/1989 Roy
4,848,614 A 7/1989 Csaszar
4,856,665 A 8/1989 Dutt
4,938,370 A 7/1990 Mcbride
4,978,016 A 12/1990 Hayes
4,981,230 A 1/1991 Marshall
4,997,097 A 3/1991 Krautkraemer
5,052,574 A 10/1991 McKinnon
5,062,538 A 11/1991 Ochs
5,076,453 A 12/1991 Odet
5,090,788 A 2/1992 Ingram
5,096,079 A * 3/1992 Odet ..... B65D 41/3428 215/258
5,145,078 A 9/1992 Hannon
5,207,783 A 5/1993 Burton
5,346,082 A 9/1994 Ochs
5,456,375 A 10/1995 May
5,465,876 A 11/1995 Crisci
5,472,106 A 12/1995 Nofer
5,547,092 A 8/1996 Thompson
5,564,582 A 10/1996 Kamath
5,573,128 A 11/1996 Tsujiguchi
5,673,808 A 10/1997 Valyi
5,678,714 A 10/1997 Guglielmini
5,690,882 A 11/1997 Sprowl
5,711,443 A 1/1998 Bennett
5,715,959 A 2/1998 Pfefferkorn
5,720,402 A 2/1998 May
5,725,115 A 3/1998 Bosl
5,749,484 A 5/1998 Trout
5,769,263 A 6/1998 Willingham
5,806,707 A 9/1998 Boehm
5,813,563 A 9/1998 Boehm
5,862,953 A 1/1999 Long, Jr.
5,891,380 A 4/1999 Larue
5,913,436 A 6/1999 Breuer
5,915,579 A 6/1999 Przytulla
5,957,315 A 9/1999 Kaitsuka
5,979,682 A 11/1999 Zumbuhl
5,984,124 A 11/1999 Takano
6,029,834 A 2/2000 Sanner
6,039,196 A 3/2000 Ekkert
6,050,436 A 4/2000 Bennett
6,123,212 A 9/2000 Russell
6,213,321 B1 4/2001 Zumbuhl
6,253,939 B1 7/2001 Wan
6,253,940 B1 7/2001 Graham
6,325,226 B1 12/2001 Krautkramer
6,332,550 B1 12/2001 Bennett
6,557,714 B2 5/2003 Babcock
6,581,792 B1 6/2003 Limanjaya
6,758,359 B2 7/2004 Yurkewicz
6,769,575 B1 8/2004 Long, Jr.
6,779,672 B2 8/2004 Kano
7,014,055 B2 3/2006 Kano
7,243,807 B2 7/2007 Lin
7,264,131 B2 9/2007 Tsutsumi
D578,889 S 10/2008 Sadiq
7,445,130 B2 11/2008 Bosl
7,451,898 B2 11/2008 Seidita
7,503,468 B2 3/2009 Druitt
7,537,159 B2 5/2009 Mugica
7,575,121 B2 8/2009 Ooka
7,581,652 B2 9/2009 Flak, Jr.
7,607,547 B2 10/2009 Kumata
7,637,384 B2 12/2009 Price
7,645,414 B2 1/2010 Gregory
7,651,004 B2 1/2010 Fuchs
7,703,642 B2 4/2010 Scott
7,780,024 B1 8/2010 Marsella
7,802,690 B2 9/2010 Lohrman
7,857,154 B2 12/2010 Pedlar
7,867,425 B2 1/2011 Major
7,878,351 B2 2/2011 Falzoni
7,905,820 B2 3/2011 Druitt
8,066,133 B2 11/2011 Takamatsu
8,231,018 B2 7/2012 Gassner
8,353,413 B2 1/2013 Ekkert
8,365,934 B2 2/2013 Hamana
8,393,483 B2 3/2013 Druitt
8,485,374 B2 7/2013 Gevers
8,544,666 B2 10/2013 Velmer
8,763,830 B2 7/2014 Sadiq
8,807,360 B2 8/2014 Erspamer
9,085,385 B1 7/2015 Costanzo, Jr.
9,085,395 B2 7/2015 Sadiq
9,126,726 B2 9/2015 Edie
9,790,005 B2 10/2017 Sadiq
10,214,325 B2 * 2/2019 Rognard ..... B65D 47/0852
10,287,065 B2 5/2019 Widmer
10,308,400 B2 6/2019 Edie
10,336,507 B2 7/2019 Sadiq
10,407,225 B2 9/2019 Schlusemann
10,934,063 B2 3/2021 Benoit-Gonin
11,273,962 B2 3/2022 Elliott
11,738,911 B2 8/2023 Falzoni
11,945,625 B2 4/2024 Owen
2001/0002661 A1 6/2001 Reidenbach
2001/0027957 A1 10/2001 Kano
2003/0071007 A1 4/2003 Ma
2003/0102280 A1 6/2003 Odet
2003/0150833 A1 8/2003 Shenkar
2004/0020943 A1 2/2004 Shinozaki
2004/0026288 A1 2/2004 Zumbuhl
2004/0060893 A1 4/2004 Kano
2004/0074861 A1 4/2004 Chuang
2004/0155006 A1 8/2004 Seidita
2004/0238478 A1 12/2004 Druitt
2005/0077264 A1 4/2005 Fuchs
2005/0173367 A1 8/2005 Nusbaum
2005/0211659 A1 9/2005 Tsutsumi
2005/0252878 A1 11/2005 Babcock
2006/0021959 A1 2/2006 Falzoni
2006/0032831 A1 2/2006 Major
2006/0138071 A1 6/2006 Tsutsumi
2006/0138073 A1 6/2006 Ooka
2006/0151418 A1 7/2006 Scott
2006/0151423 A1 7/2006 Seidita
2006/0255002 A1 11/2006 Takamatsu
2006/0255003 A1 11/2006 Fuchs
2006/0283828 A1 * 12/2006 Falzoni ..... B65D 41/3428 215/200
2007/0023380 A1 2/2007 Shingle
2007/0034590 A1 2/2007 Hidding
2007/0090080 A1 4/2007 Lohrman
2007/0181525 A1 8/2007 Gregory
2008/0067142 A1 3/2008 Druitt
2008/0087625 A1 4/2008 Kumata

(56) References Cited

U.S. PATENT DOCUMENTS

| | | | | |
|---|---|---|---|---|
| 2008/0093363 | A1 | 4/2008 | Pedlar | |
| 2008/0169262 | A1 | 7/2008 | Ekkert | |
| 2008/0173611 | A1 | 7/2008 | Neputy | |
| 2008/0314000 | A1 | 12/2008 | Druitt | |
| 2009/0045158 | A1 | 2/2009 | Suriol | |
| 2009/0159555 | A1 | 6/2009 | Druitt | |
| 2009/0261057 | A1 | 10/2009 | Druitt | |
| 2010/0038337 | A1 | 2/2010 | Garboni | |
| 2010/0264110 | A1 | 10/2010 | Sumimiya | |
| 2010/0276387 | A1 | 11/2010 | Hamana | |
| 2011/0036839 | A1 | 2/2011 | Gardner | |
| 2015/0129534 | A1 | 5/2015 | Falzoni | |
| 2017/0043921 | A1 | 2/2017 | Elliott | |
| 2017/0066164 | A1* | 3/2017 | Luzzato | B29C 45/0055 |
| 2017/0349336 | A1 | 12/2017 | Sadiq | |
| 2018/0099795 | A1 | 4/2018 | Migas | |
| 2018/0118418 | A1 | 5/2018 | Nakamura | |
| 2019/0337691 | A1 | 11/2019 | Kim | |
| 2020/0115115 | A1 | 4/2020 | Migas | |
| 2020/0180819 | A1 | 6/2020 | Berroa | |
| 2020/0223597 | A1* | 7/2020 | Neputy | B65D 41/3423 |
| 2020/0331663 | A1 | 10/2020 | Edie | |
| 2020/0384714 | A1 | 12/2020 | Migas | |
| 2022/0048680 | A1 | 2/2022 | Grabarczyk | |
| 2022/0073237 | A1 | 3/2022 | Ooka | |
| 2022/0097935 | A1 | 3/2022 | Deshpande | |
| 2024/0327072 | A1 | 10/2024 | Kittleson | |

FOREIGN PATENT DOCUMENTS

| | | | |
|---|---|---|---|
| DE | 19708909 | A1 | 9/1998 |
| EP | 1953091 | A1 | 8/2008 |
| EP | 2607252 | A1 | 6/2013 |
| FR | 2278643 | A1 | 2/1976 |
| FR | 2987607 | A1 | 9/2013 |
| FR | 3074785 | A1 | 6/2019 |
| IT | 20100359 | A1 | 6/2012 |
| IT | 20100360 | A1 | 6/2012 |
| JP | 5395355 | U | 8/1978 |
| JP | 08034458 | A | 2/1996 |
| JP | 6281029 | B1 | 2/2018 |
| WO | 198303809 | A1 | 11/1983 |
| WO | 2005014414 | A1 | 2/2005 |
| WO | 2009027227 | A1 | 3/2009 |
| WO | 2009154666 | A2 | 12/2009 |
| WO | 2013132384 | A1 | 9/2013 |
| WO | 2015123666 | A1 | 8/2015 |
| WO | 2015162128 | A1 | 10/2015 |
| WO | 2017061001 | A1 | 4/2017 |
| WO | 2017068151 | A1 | 4/2017 |
| WO | 2017133948 | A1 | 8/2017 |
| WO | 2020240518 | A1 | 12/2020 |

OTHER PUBLICATIONS

U.S. Appl. No. 29/755,893, now allowed, filed Oct. 23, 2020, Rishi Deshpande, Closure With Tamper-Evident Band.

* cited by examiner

CLOSURE WITH TAMPER-EVIDENT BAND

CROSS-REFERENCE TO RELATED APPLICATIONS

This application claims priority to and benefit of U.S. Provisional Patent Application No. 63/627,617 filed Jan. 31, 2024, which is hereby incorporated by reference herein in its entirety.

FIELD OF THE INVENTION

The present invention relates generally to a polymeric closure for a package. More specifically, the present invention relates to a polymeric closure with a tamper-evident band.

BACKGROUND OF THE INVENTION

Polymeric closures have been used in many applications over the years in conjunction with containers to form a package. Some polymeric closures include a tamper-evident band that assists a user in determining whether the closure has been previously opened. One of the methods of tamper-evident bands failing is not properly unfolding. The feature on a container finish that the tamper-evident band may catch on is often a substantially smaller diameter than the transition or root between two portions that form the tamper-evident band. This causes the tamper-evident band to fold and revert because the force to revert is less than the force to break the tamper-evident band. It is desirable to move the transition or root of the tamper-evident band inward so that if the tamper-evident band catches the finish, it is pushed straight down on the tamper-evident band with no room to unfold. This, however, present additional problems in that if the tamper-evident band does not have sufficient room to fold out of the way when the closure is applied, the features attaching the tamper-evident band to the closure when pressed between surfaces can frequently break.

It would be desirable to provide a closure with a tamper-evident band that addresses these problems, while still retaining other desirable features of a closure.

SUMMARY

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter. This summary is also not intended to be used in isolation to determine the scope of the claimed subject matter. The subject matter should be understood by reference to appropriate portions of the entire specification of this disclosure, any or all drawings and each claim.

According to one aspect of the present disclosure, a closure comprises a first closure portion and a second closure portion. The first closure portion includes a polymeric top wall portion and a polymeric annular skirt portion. The polymeric annular skirt portion depends from the polymeric top wall portion. The annular skirt portion includes an exterior surface and an interior surface. The interior surface of the annular skirt portion includes an internal thread formation for mating engagement with an external thread formation of a container. The second closure portion including a polymeric tamper-evident band depending from and is at least partially detachably connected to the polymeric annular skirt portion by a frangible connection. The polymeric tamper-evident band includes a first portion and a second portion connected via a bending area. The first portion has a flared end in which the thickness of the flared end is at least 1.25 times greater than the thickness of a directly adjacent section of the first portion. The second portion extends generally upwardly from the bending area towards the polymeric top wall portion and is located inwardly from the first portion of the polymeric tamper-evident band. The second portion of the tamper-evident band includes a tab portion and an extension portion. The tab portion includes an upper section and a lower section. The upper section of the tab portion is located closer to the extension portion than the bending area. The lower section of the tab portion is located closer to the bending area than the extension portion. The extension portion is located further from the bending area than the tab portion. The average thickness of the tab portion is greater than the average thickness of the extension portion. The extension portion extends continuously around an entire inner circumference of the closure.

According to a further configuration of the above implementation, the thickness of the flared end is at least 1.5 times greater than the thickness of the directly adjacent section of the first portion.

In a further aspect of the above implementation, the thickness of the flared end is at least 1.75 times greater than the thickness of the directly adjacent section of the first portion.

In a further aspect of the above implementation, the thickness of the flared end is from about 1.25 to about 2.5 times greater than the thickness of the directly adjacent section of the first portion.

In yet a further aspect of the above implementation, the thickness of the flared end is from about 1.5 to about 2.5 times greater than the thickness of the directly adjacent section of the first portion.

According to a further configuration of the above implementation, the extension portion is spaced entirely from the interior surface of the polymeric annular skirt portion before mating engagement with the container.

In a further aspect of the above implementation, the tab portion and the extension portion are substantially vertical after fitment with a container.

According to a configuration of the above implementation, the extension portion of the tamper-evident band is at an angle of from 5 to about 30 degrees inwardly relative to an axis extending to the polymeric top wall portion before mating engagement with the container. In another embodiment, the extension portion of the tamper-evident band is at an angle of from 10 to about 25 degrees inwardly relative to an axis extending to the polymeric top wall portion before mating engagement with the container. In further embodiment, the extension portion of the tamper-evident band is at an angle of from 10 to about 20 degrees inwardly relative to an axis extending to the polymeric top wall portion before mating engagement with the container.

In yet a further aspect of the above implementation, the average thickness of the tab portion is from about 2 to about 8 times greater than the average thickness of the extension portion. In a further embodiment, the average thickness of the tab portion is from about 3 to about 6 times greater than the average thickness of the extension portion.

According to a further configuration of the above implementation, the length of the tab portion is from about 0.75 to about 3 times greater than the length of the extension portion. In a further embodiment, the length of the tab portion is from about 1 to about 2 times greater than the length of the extension portion.

In a further aspect of the above implementation, the closure is a one-piece closure.

According to another aspect of the present disclosure, a package includes a container and a closure. The container has a neck portion defining an opening. The container has an external thread formation on the neck portion. The closure is configured for fitment to the neck portion of the container for closing the opening. The closure includes a first closure portion and a second closure portion. The first closure portion includes a polymeric top wall portion and a polymeric annular skirt portion. The polymeric annular skirt portion depends from the polymeric top wall portion. The annular skirt portion includes an exterior surface and an interior surface. The interior surface of the annular skirt portion includes an internal thread formation for mating engagement with an external thread formation of a container. The second closure portion including a polymeric tamper-evident band depending from and is at least partially detachably connected to the polymeric annular skirt portion by a frangible connection. The polymeric tamper-evident band includes a first portion and a second portion connected via a bending area. The first portion has a flared end in which the thickness of the flared end is at least 1.25 times greater than the thickness of a directly adjacent section of the first portion. The second portion extends generally upwardly from the bending area towards the polymeric top wall portion and is located inwardly from the first portion of the polymeric tamper-evident band. The second portion of the tamper-evident band includes a tab portion and an extension portion. The tab portion includes an upper section and a lower section. The upper section of the tab portion is located closer to the extension portion than the bending area. The lower section of the tab portion is located closer to the bending area than the extension portion. The extension portion is located further from the bending area than the tab portion. The average thickness of the tab portion is greater than the average thickness of the extension portion. The extension portion extends continuously around an entire inner circumference of the closure.

According to a further configuration of the above implementation, the thickness of the flared end is at least 1.5 times greater than the thickness of the directly adjacent section of the first portion.

In a further aspect of the above implementation, the thickness of the flared end is from about 1.25 to about 2.5 times greater than the thickness of the directly adjacent section of the first portion.

In a further aspect of the above implementation, the thickness of the flared end is from about 1.5 to about 2.5 times greater than the thickness of the directly adjacent section of the first portion.

In a further aspect of the above implementation, the extension portion is spaced entirely from the interior surface of the polymeric annular skirt portion before mating engagement with the container.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1A:
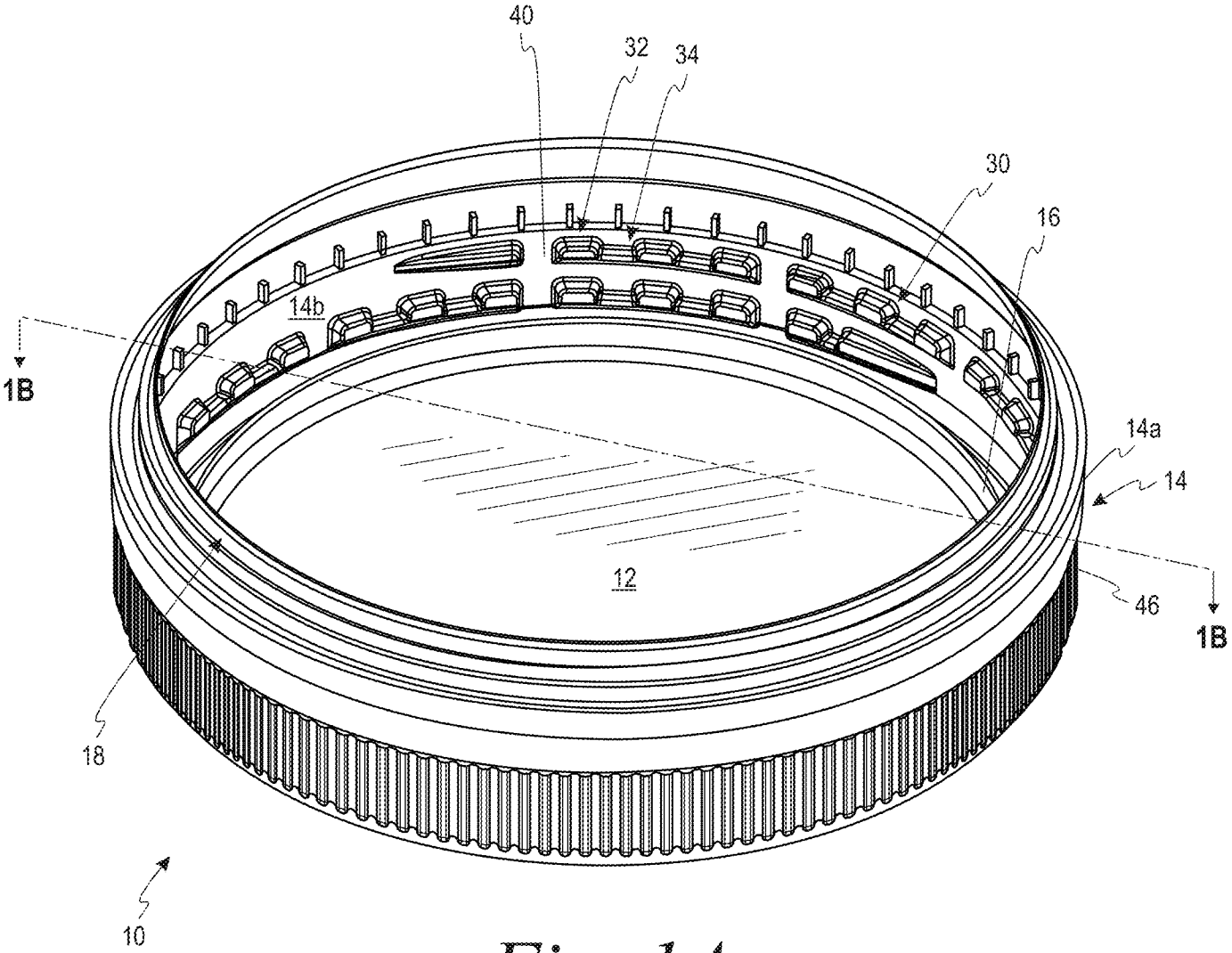
FIG. 1A is a bottom perspective view of a polymeric closure in a molded position according to one embodiment.
Figure 1B:
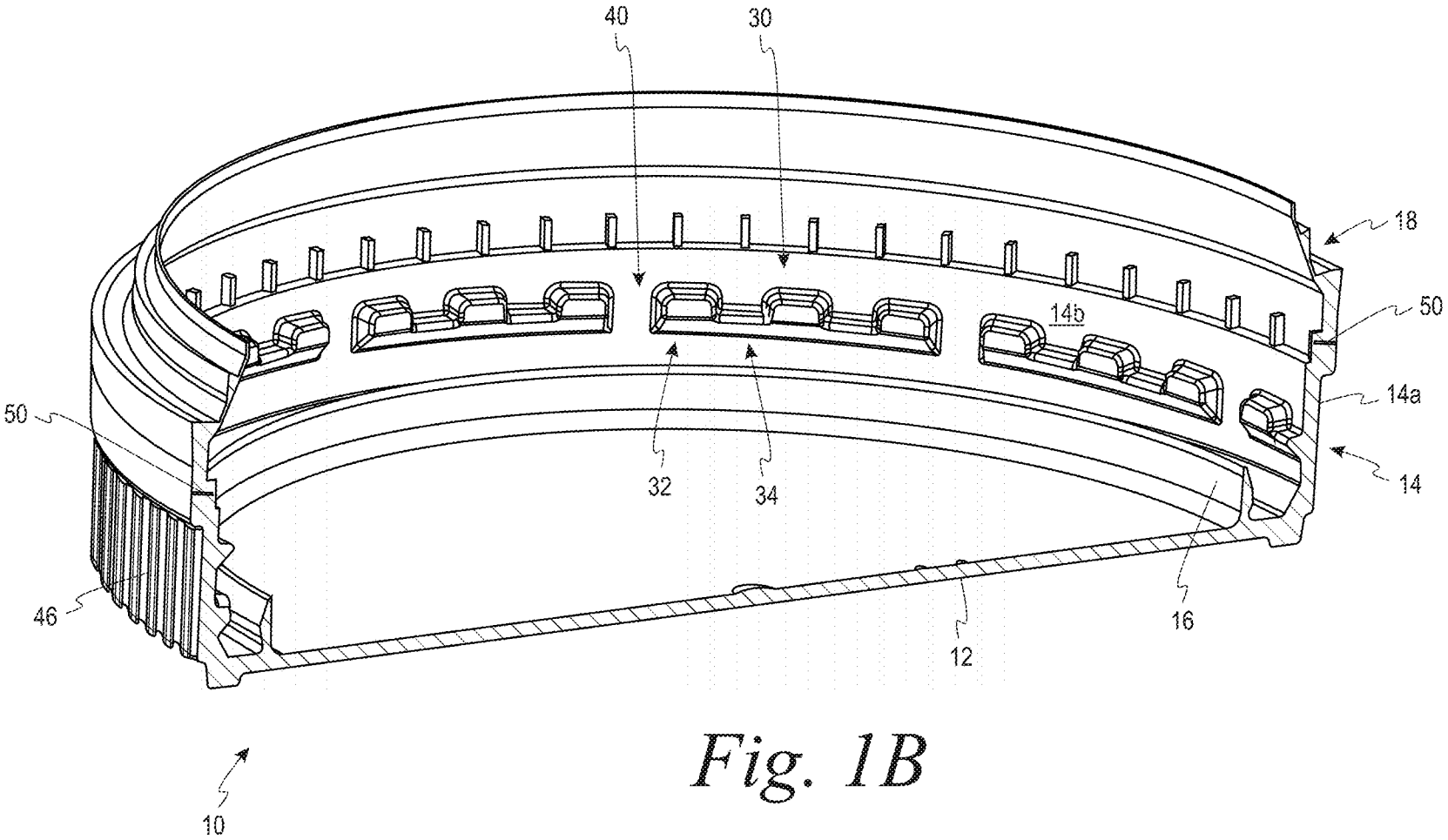
FIG. 1B is an enlarged cross-sectional view of the closure of FIG. 1A taken generally along line 1B-1B.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Various embodiments are described with reference to the attached figures, where like reference numerals are used throughout the figures to designate similar or equivalent elements. The figures are not drawn to scale and are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details, or with other methods. In other instances, well-known structures or operations are not shown in detail to avoid obscuring the invention. The various embodiments are not limited by the illustrated ordering of acts or events, as some acts may occur in different orders and/or concurrently with other acts or events. Furthermore, not all illustrated acts or events are required to implement a methodology in accordance with the present invention.

Various embodiments are described with reference to the attached figures, where like reference numerals are used throughout the figures to designate similar or equivalent elements. The figures are not drawn to scale and are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details, or with other methods. In other instances, well-known structures or operations are not shown in detail to avoid obscuring the invention. The various embodiments are not limited by the illustrated ordering of acts or events, as some acts may occur in different orders and/or concurrently with other acts or events. Furthermore, not all illustrated acts or events are required to implement a methodology in accordance with the present invention.

Figure 2:
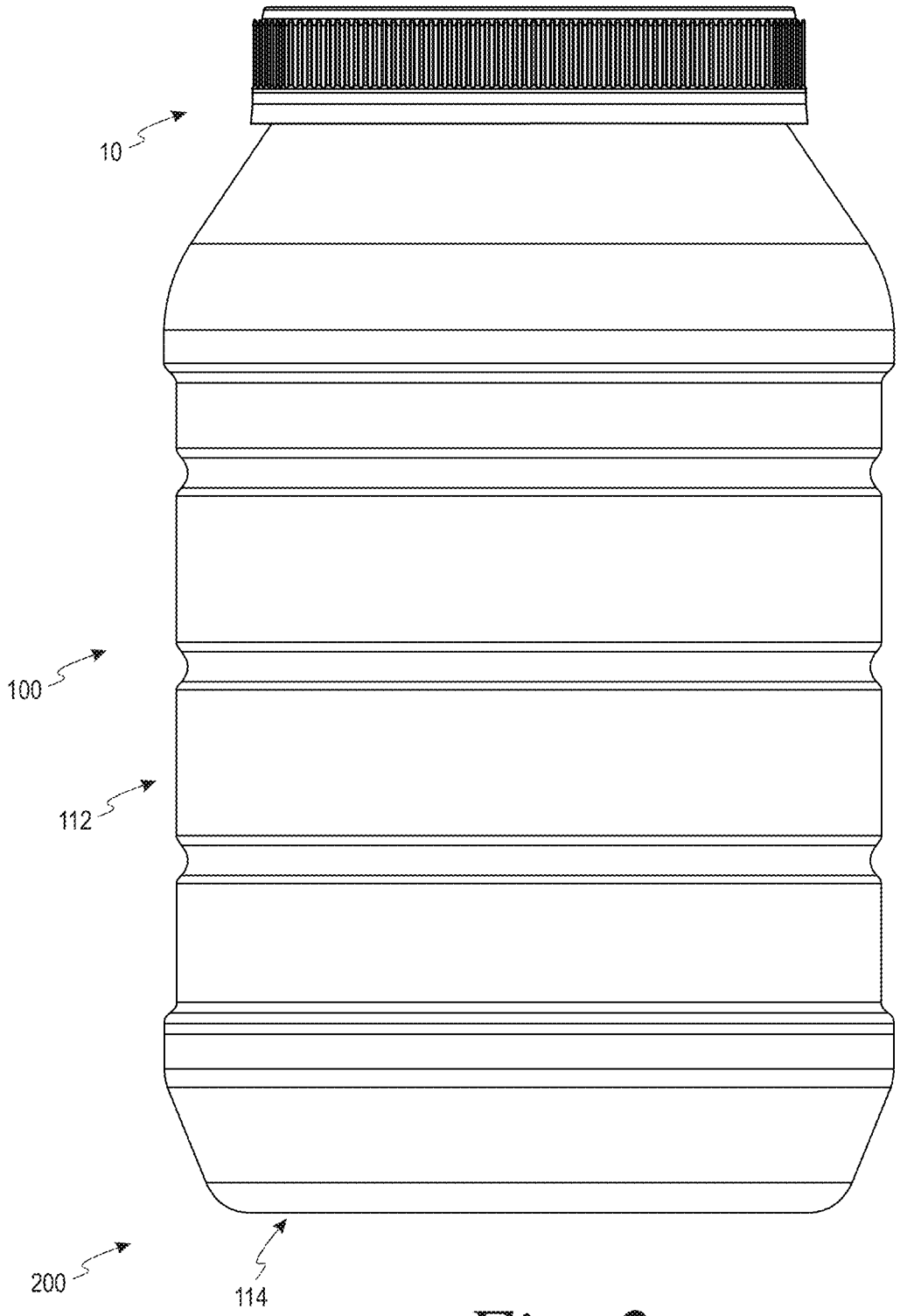
FIG. 2 is a front view of a package with the closure of FIG. 1A according to one embodiment.
Figure 3A:
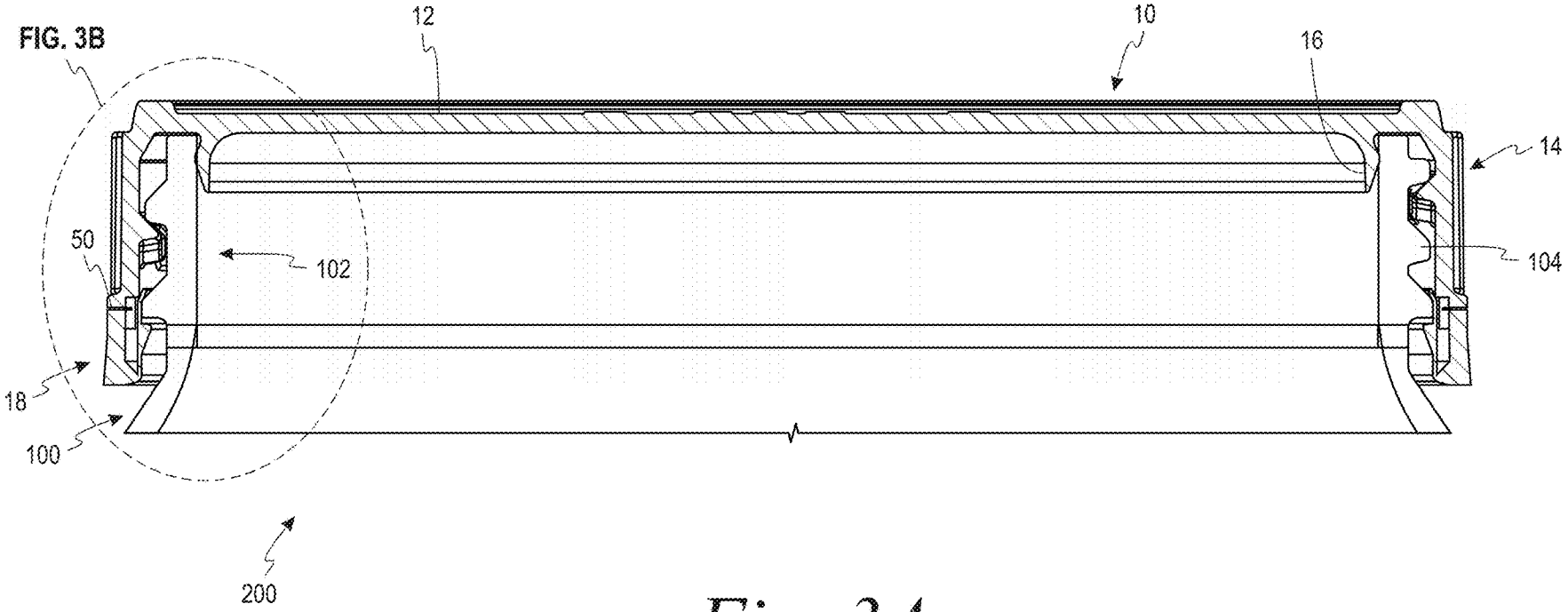
FIG. 3A is a cross-sectional view of the package of FIG. 2A.
Figure 3B:
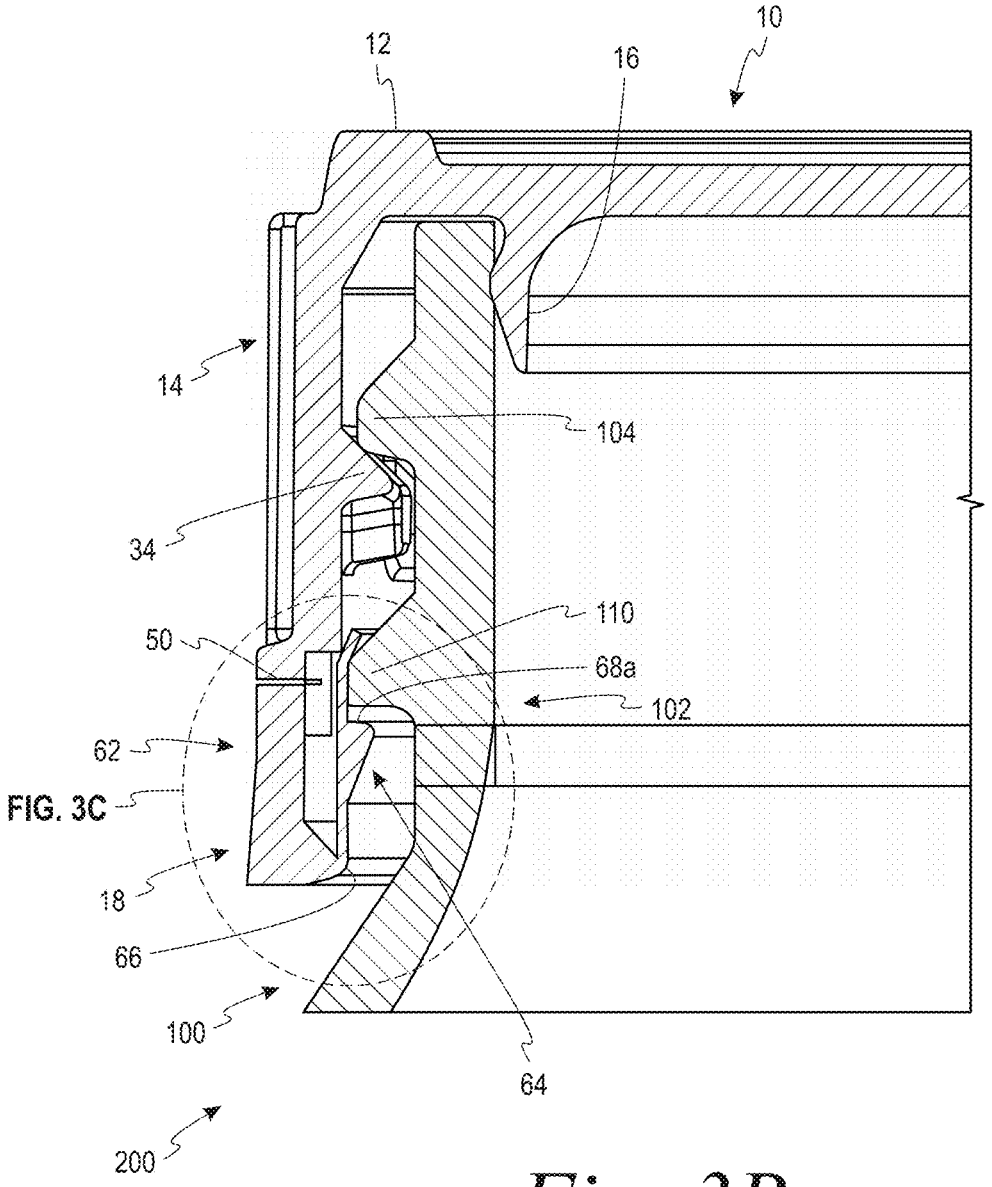
FIG. 3B is an enlarged view of area FIG. 3B in FIG. 3A.
Figure 3C:
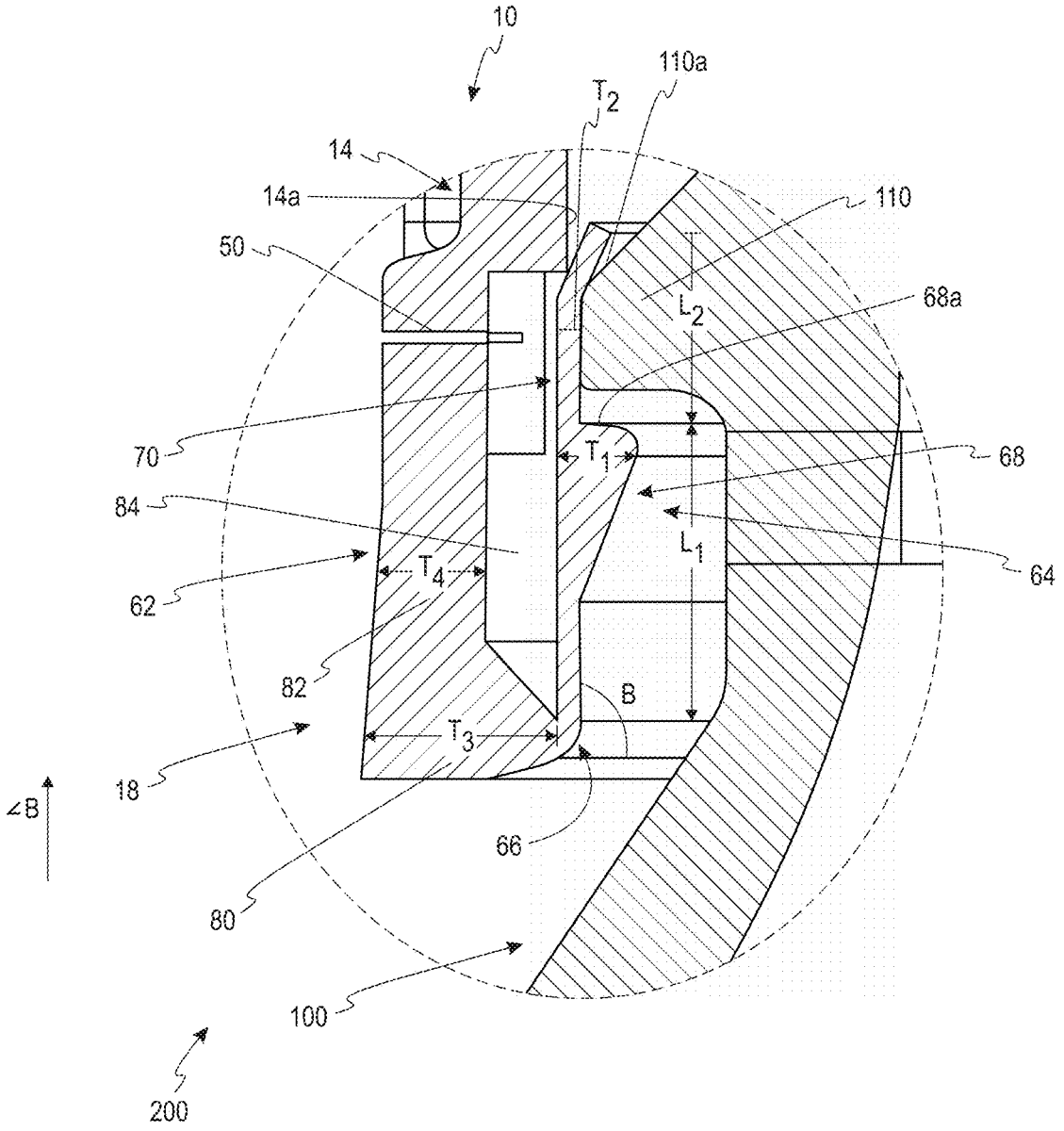
FIG. 3C is an enlarged view of area FIG. 3C in FIG. 3B.

FIGS. 1A-1D illustrate a polymeric closure 10 according to one embodiment of the present invention. The closures are configured to be placed on a container or bottle that contain product. The product is typically a liquid product, but also may be a solid product or a combination of a liquid and solid product. The polymeric closure 10 of FIGS. 1A-1D is a one-piece closure assembly. It is contemplated that the polymeric closure may be a two-piece assembly. The polymeric closure 10 is generally cylindrically shaped. FIGS. 2-3C show a package 200 with the polymeric closure 10 and a container 100.

Referring back to FIGS. 1A-1D, the polymeric closure 10 includes a polymeric top wall portion 12, a polymeric annular skirt portion 14 that depends from the polymeric top wall portion 12, a polymeric continuous plug seal 16, and a tamper-evident band 18. The top wall portion 12 extends across the entire top of the polymeric closure 10 without any openings.

Figure 1C:
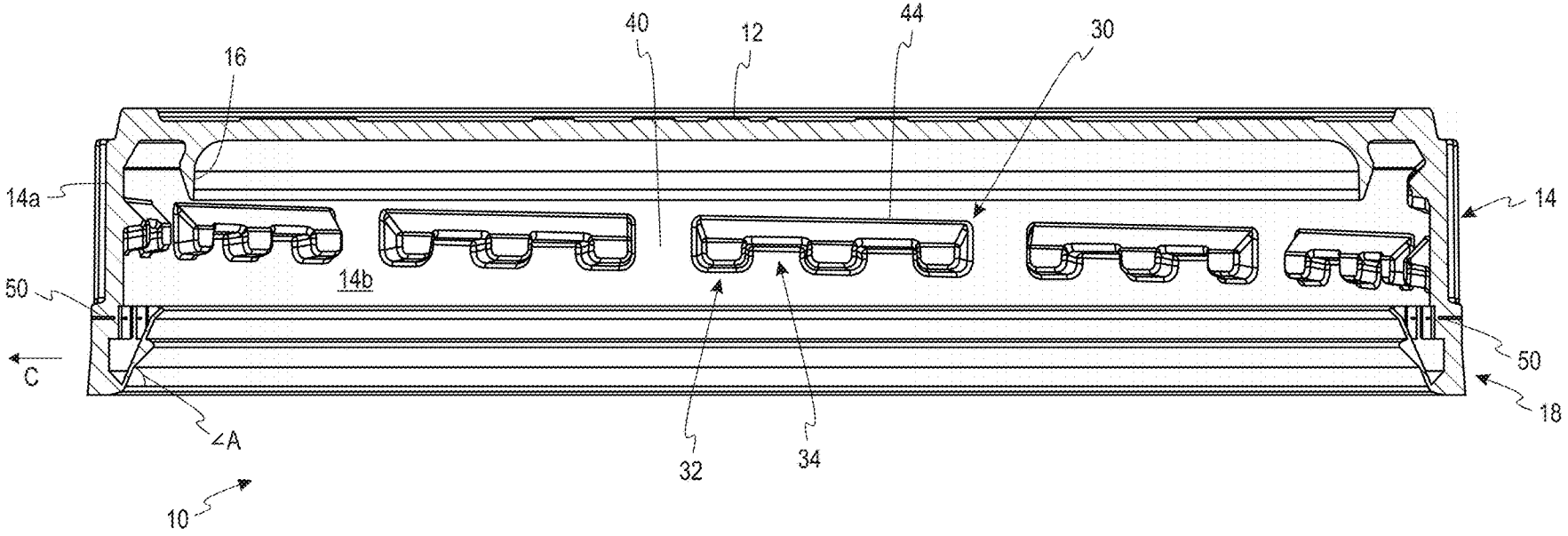
FIG. 1C is a cross-sectional view of the closure of FIG. 1A with the tamper-evident band being in a functional position.

The polymeric continuous plug seal 16 depends from the polymeric top wall portion 12 as shown best in FIG. 1C. The continuous plug seal 16 works in conjunction with the finish of the container to form a seal. The continuous plug seal 16 is spaced from and is not directly connected to the polymeric annular skirt portion 14. By being disconnected from the annular skirt portion 14, any impact to an exterior surface 14*a* of the polymeric annular skirt portion 14 will have less risk of being transferred to the finish of the container, which can potentially disturb the seal between the continuous plug seal 16 and the finish. Such a disturbance can cause a loss in product integrity.

It is contemplated that other sealing mechanisms may be used instead or in addition to the continuous plug seal. For example, sealing mechanisms such as an outer seal or a top seal may be used. The top seal assists in providing a positive stop when the finish of the container and the closure are being threaded with each other. Thus, the top seal assists in positioning the finish of the container when the closure is being threaded onto the finish.

The polymeric annular skirt portion 14 includes the exterior surface 14*a* and an interior surface 14*b*. The interior surface 14*b* of the polymeric annular skirt portion 14 includes an internal thread formation 30. The internal thread formation 30 is configured for mating engagement with a corresponding external thread formation of a neck portion of a container.

The internal thread formation 30 depicted in FIGS. 1A-1D is a single closure lead that extends around at least a periphery of the interior surface 14*b* of the polymeric annular skirt portion 14. As shown in FIG. 1A, portions of the internal thread formation 30 overlap with each other. The internal thread formation is a helical thread formation. The internal thread formation 30 is shown as being discontinuous in FIGS. 1A-1D in that there are spaces 40 located between individual segments of the internal thread formation 30.

Referring specifically to FIG. 1C, the internal thread formation 30 includes a plurality of alternating bumps 32 and a plurality of valleys 34. The plurality of bumps 32 assists in providing quicker vertical travel during unthreading. The plurality of valleys 34 assists in supporting the plurality of bumps 32, especially during the threading and unthreading operations.

The plurality of bumps and the plurality of valleys are generally polygonal in shape as viewed from an interior of the closure. More specifically, the plurality of bumps and the plurality of valleys are generally rectangular in shape. It is contemplated that the plurality of bumps and valleys may be of different shapes than rectangular including other polygonal shapes such as triangular or other non-polygonal shapes such as sinusoidal.

It is contemplated that the internal thread formation may be continuous in another embodiment instead of being discontinuous as shown in FIGS. 1A-1D. In such an embodiment, for example, the spaces 40 may be replaced with valleys, but the plurality of bumps and plurality of valleys would be included such as those shown in FIGS. 1A-1D.

In another embodiment, an internal thread formation may be formed with a plurality of closure leads. For example, there may be two or three closure leads in an internal thread formation. In a two closure lead embodiment, a first closure lead begins near the polymeric top wall portion at a first position and extends in a helical fashion to a second position closer to the tamper-evident band. Similarly, the second closure lead begins near the polymeric top wall portion at a first position and extends in a helical fashion to a second position closer to the tamper-evident band. The first and second closure leads are referred collectively as a double lead closure thread. The first and second closure leads may be continuous or discontinuous. The first positions of the first and second closure leads are located roughly 180 degrees apart from each other and, thus, begin on generally opposing sides of the closure. In such an embodiment, for example, the plurality of bumps and plurality of valleys would be included such as those shown in FIGS. 1A-1D in forming the plurality of closure leads.

The polymeric tamper-evident band 18 is located at the bottom thereof (i.e., an end opposite of the polymeric top wall portion 12). The tamper-evident band 18 depends from and is at least partially detachably connected to the polymeric annular skirt portion 14 by a frangible connection 50. Once the closure moves from an initial closed position to an open position, the polymeric tamper-evident band 18 is desirably fully detached from the polymeric annular skirt portion 14. More specifically, the tamper-evident band 18 is designed to at least partially separate from the annular skirt portion 14 if a user opens the package by unthreading and removing the closure to gain access to the container. The tamper-evident band 18 works in conjunction with the container to indicate to a user that the contents of the container may have been accessed.

The polymeric tamper-evident band may be formed by molded-in-bridges in one embodiment. The molded-in-bridges are typically formed using a feature in the mold. In another embodiment, the polymeric tamper-evident band may be formed using scoring or scored lines, notches, leaders, or other lines of weaknesses.

The tamper-evident band 18 is in a reversed orientation (as molded condition) in FIG. 1A. This is a common orientation when the closure is removed from a mold and allows the closure to be ejected more easily from the closure-forming tooling. The tamper-evident band is later folded from the reversed orientation into a functional orientation, which is shown in FIG. 1C.

Figure 1D:
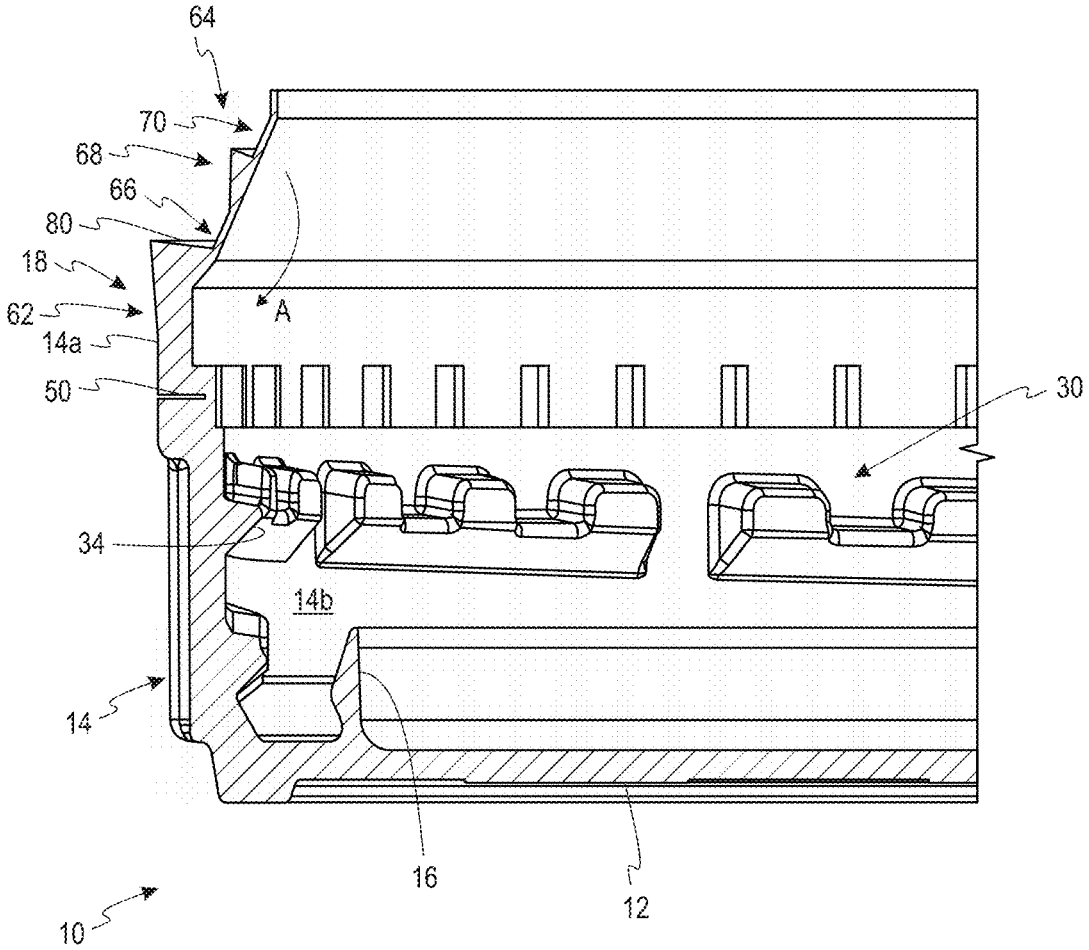
FIG. 1D is an enlarged cross-sectional view of a portion of the closure of FIG. 1A in a molded position.

Referring to FIG. 1D, the polymeric tamper-evident band 18 includes a first portion 62 and a second portion 64 connected via a bending area 66. The first portion 62, the second portion 64 and the bending area 66 are typically integrally connected. The second portion 64 is folded over inwardly and upwardly (see arrow A in FIG. 1D) into its functional orientation (FIG. 1C), which is in the direction of the polymeric top wall portion 12. Referring to FIG. 3B, the second portion 64 extends generally upwardly from the bending area 66 and is located inwardly from the first portion 62 of the tamper-evident band 18.

It is noted that when manufacturing the closure, the second portion 64 initially extends downwardly (see, for example, FIG. 1B) in generally the opposite direction of the polymeric top wall portion 12. Specifically, the second portion 64 of the tamper-evident band 18 is positioned roughly or substantially axially to the first portion 62 before being folded over and inwardly in the manufacturing process via the bending area 66 into the position shown in FIG. 1C.

Referring to FIG. 3C, the first portion 62 of the tamper-evident band includes a flared end 80 to assist in preventing or inhibiting the tamper-evident band 18 from unfolding improperly. The flared end 80 of the first portion 62 is located opposite of the polymeric top wall portion 12 and is next to the bending point 66. More specifically, the flared end 80 assists in positioning the second portion 64 of the tamper-evident band 18 so as to catch on the finish such that the tamper-evident band 18 is pushed straight down on the transition or root of the tamper-evident band 18 with no room to unfold. The transition or root is a portion of the bending area 66. The flared end 80 as shown best in FIG. 3C extends into the bending point 66 that connects the first portion 62 and the second portion 64. The flared end 80 of the first portion 62 is thicker than the remainer of a directly adjacent section 82 to the flared end 80. This is shown best in FIG. 3C where the thickness T3 of the flared end 80 is greater than the thickness T4 of an adjacent section 82 of the first portion 62.

In one embodiment, the thickness T3 of the flared end 80 is at least 1.25 times greater than the thickness T4 of the directly adjacent section 82 of the first portion 62. In another embodiment, the thickness T3 of the flared end 80 is at least 1.5 times greater than the thickness T4 of the directly adjacent section 82 of the first portion 62. In a further embodiment, the thickness T3 of the flared end 80 is at least 1.75 times greater than the thickness T4 of the directly adjacent section 82 of the first portion 62. The thickness T3 of the flared end 80 is generally from about 1.25 to about 3 times greater than the thickness T4 of the directly adjacent section 82 of the first portion 62. The thickness T3 of the flared end 80 is typically from about 1.5 to about 2.5 times greater than the thickness T4 of the directly adjacent section 82 of the first portion 62. The thickness T3 of the flared end 80 is also typically from about 1.5 to about 2 times greater than the thickness T4 of the directly adjacent section 82 of the first portion 62.

By having the directly adjacent section 82 to the flared end 80 being thinner, this results in a gap 84 that is formed. This gap 84 is shown best in FIG. 3C. The gap 84 provides space or room for the tamper-evident band 18 when the closure 10 is applied to the container 100. This assists in preventing or inhibiting a situation where the tamper-evident band is being pressed against the closure with the possibility of breaking the features of the tamper-evident band 18. In other words, the gap 84 provides space for the tamper-evident band 18 to move out of the way during the application of the closure onto the container.

The second portion 64 of the tamper-evident band 18 includes a tab portion 68 and an extension portion 70. The extension portion 70 assists in initially locating and maintaining the position of the tab portion 68 during the opening process. The extension portion 70 is located further from the bending area 66 than the tab portion 68 as shown in FIGS. 1D, 3C. As shown in FIG. 3C, the tab portion 68 and the extension portion 70 are generally vertical. This is shown by the direction of arrow B in, for example, FIG. 3C. The tab portion and the extension portion may be substantially vertical or vertical in another embodiment. The tab portion and the extension portion are within 5% of vertical in one embodiment and within 10% of vertical in another embodiment.

It is desirable for the tab portion 68 and the extension portion 70 to be vertical or substantially vertical so as to prevent or inhibit the tab portion 68 from rotating inwardly towards an exterior wall of a container or bottle finish, or by unfolding. It is desirable for the tab portion 68 and the extension portion 70 to be substantially vertical to prevent or inhibit from being located too sharply against the interior surface 14*b* of the polymeric annular skirt portion 14.

By keeping the tab portion 68 from rotating inwardly or unfolding assists in avoiding or inhibiting problems in the opening process by a user. Specifically, when a user applies vertical and axial forces in opening the closure, it is desirable for these forces to be substantially applied to breaking the frangible connection instead of transmitting the energy into moving (i.e., rotating or unfolding) the tab portion 68. When the tab portion remains generally in place, the vertical and axial forces from the user transmits only to or substantially to the opening of the frangible connections (e.g., breaking the bridges).

If the tab portion moves inwardly towards an exterior wall of the bottle finish or the tab portion unfolds, this can lead to undesirable results. For example, if a certain percentage of the bridges in the frangible connections are not broken (typically on one side) because energy is transmitted into moving the tab portion, a user may have difficulty in opening and accessing the contents of the container. Specifically, when some of the bridges remain unbroken, this can lead to a tether-like or hinged-band scenario. This can lead to the closure being in a hanging or stuck position. When bridges remain unbroken, the closure becomes looser with more ability or freedom to move around, resulting in potential undesirable movement. For example, a side-to-side movement of the closure can result in a user inadvertently pulling the closure to one side that makes the closure off-centered.

When all of the bridges are not broken, several scenarios can occur. In one scenario, the entire tamper-evident band may go underneath the A-collar or A-diameter of the finish, which may make the closure difficult to open. In another scenario, some section of the tamper-evident band may lift over and partly above the A-collar of the finish, which leads to a hiked band that makes the closure difficult to open. In a further scenario, the positioning of the tab portion could lead to the tamper-evident band riding entirely over an A-collar of the finish and coming off with the remainder of the closure when the container is being opened. This is undesirable for several reasons including making the opening of the container more difficult and defeating the tamper-evident aspects of the package because the tamper-evident band should remain with the container after the closure is unthreaded.

The tab portion 68 is desirably positioned to remain below and adjacent to a bottom surface of an A-collar of the finish of the container. The tab portion 68 as discussed above is desirably spaced from an exterior wall of the container finish. The tab portion 68 includes a ledge 68*a*. The ledge 68*a* desirably seals under the A-collar of the finish.

The extension portion 70 extends continuously around the entire inner circumference in one embodiment. The outer circumference of the closure 10 is formed by the polymeric annular skirt portion 14. The inner circumference of the closure is formed by the second portion 64 of the tamper-evident band 18.

In another embodiment, the extension portion extends around the entire inner circumference of the closure in a substantially continuous manner. This embodiment also assists in placing and positioning the extension portion adjacent to and abutting an exterior surface of the A-collar. In one embodiment, the extension portion extends from about 75% to about 99% around the inner circumference of the closure. In another embodiment, the extension portion extends from about 80 to about 99% around the inner circumference of the closure. In another embodiment, the extension portion extends from about 90 to about 99% around the inner circumference of the closure. In a further embodiment, the extension portion extends from about 95 to about 99% around the inner circumference of the closure. If the extension portion does not extend around the entire inner circumference of the closure in at least a substantially continuous manner, it will not desirably and consistently assist in preventing or inhibiting the extension portion from moving underneath the A-collar of the finish during the opening process.

The extension portion in a more desirable embodiment extends around the entire inner circumference of the closure and maintains a position adjacent to and abutting an exterior surface of the A-collar without the extension portion moving underneath the A-collar. By having the extension portion abutting an exterior surface of the A-collar and not being underneath the A-collar, problems discussed above such as having difficulty in opening the container or having the tamper-evident aspects defeated are substantially or entirely avoided.

As shown best in FIG. 3C, the extension portion 70 is positioned between an interior surface 14*a* of the polymeric wall portion 14 and the A-collar or A-diameter 110. It is desirable for the extension portion 70 to conform or slightly confirm with the A-collar 110 of a container continuously around the entire inner circumference of the closure. In this specific embodiment, the extension portion 70 is squeezed between the interior surface 14*a* of the polymeric wall portion 14 and the A-collar 110. By not having a gap or much of a gap therebetween, the tab portion 68 is prevented or inhibited from rotating inwardly towards an exterior wall of the container finish or unfolding further away from the A-collar. It, however, can be difficult to maintain the tolerances such that the extension portion is squeezed or pinched between the interior surface of the polymeric wall portion and the A-collar.

The extension portion 70 of the tamper-evident band 18 conforms with and abuts an exterior surface 110*a* of the A-collar 110. The extension portion 70 desirably forms a seal with the exterior surface 110*a* of the A-collar 110. The ledge 68*a* desirably is located underneath the A-collar 110 and away from the sidewall of the finish. To better conform and abut with the A-collar 110, the extension portion 70 has a smaller diameter than the A-collar 110.

It is desirable to have the extension portion 70 initially angled at angle A (FIG. 1C) such that the A-collar 110 abuts and moves the extension portion 70. It is desirable to have a more reduced angle on the same to assist in the manufacturing process of removing the closure from the associated tooling. The extension portion 70 is generally at an angle A of from about 3 to about 35 degrees. More specifically, the extension portion 70 is generally at an angle A of from about 5 to about 30 degrees, or at an angle A of from about 5 to about 25 degrees. The extension portion 70 is at an angle A is typically from about 10 to about 25 degrees, or at an angle A of from about 10 to about 20 degrees.

The diameter of the extension portion 70 is smaller than the diameter of the A-collar 110. Because the diameter of the extension portion 70 is smaller than diameter of the A-collar 110, the extension is moved outwardly (in the direction of arrow C in FIG. 1C) towards the polymeric annular skirt portion 14. The relative diameters of the extension portion 70 and the A-collar 110 also assist in positioning the second portion 64 of the tamper-evident band 18.

The thickness and the materials used to form the extension portion 70 allow it to be moved from the position in FIG. 1C to the position of FIG. 3C during the placement of the closure onto the finish of the container. The angle B of the extension portion 70 in FIG. 3C is generally from about −5 to about 35 degrees. The angle B of the extension portion 70 is typically from about 0 to about 35 degrees, and more specifically from about 0 to about 25 degrees. More specifically, the angle B of the extension portion 70 is from about 0 to about 15 degrees and, more specifically from 0 to about 10 degrees. Thus, it is contemplated that angle B may be a negative angle (past vertical and angled toward the interior surface 14*a*) after being placed onto the finish of the container. The angle B at 0 degrees is in a vertical position.

As shown in FIGS. 1C, 3C, angle A is greater than angle B. Generally, angle A is 0 to about 20 degrees greater than angle B. Typically, angle A is 0 to about 10 or about 15 degrees greater than angle B.

The average thickness of the tab portion 68 is greater than the average thickness of the extension portion 70. The average thickness T1 of the tab portion 68 as shown in FIG. 3C is generally from about 2 to about 8 times greater than the average thickness T2 of the extension portion 70. The average thickness T1 of the tab portion 68 is generally from about 2 to about 6 times greater than the average thickness T2 of the extension portion 70. The average thickness T1 of the tab portion 68 is typically from about 3 to about 6 times greater than the average thickness T2 of the extension portion 70.

The average thickness T1 of the tab portion 68 of the tamper-evident band 18 in FIG. 3C is generally from about 0.03 to about 0.075 inches. More specifically, the average thickness T1 of the tab portion 68 is from about 0.03 to about 0.06 inches.

The length L1 of the tab portion 68 of the tamper-evident band 18 in FIG. 3C is generally from about 0.05 to about 0.175 inches. More specifically, the length L1 of the tab portion 68 is from about 0.06 to about 0.16 inches, or from about 0.075 to about 0.15 inches.

The average thickness T2 of the extension portion 70 of the tamper-evident band 18 in FIG. 3C is generally from about 0.005 to about 0.025 inches. More specifically, the average thickness T2 of the extension portion 70 is from about 0.01 inches to about 0.025 inches, or from about 0.01 to about 0.02 inches.

The length L2 of the extension portion 70 of the tamper-evident band 18 in FIG. 3C is generally from about 0.05 to about 0.15 inches. More specifically, the length L2 of the extension portion 70 is from about 0.075 inches to about 0.12 inches, or from about 0.08 to about 0.10 inches.

The length of the tab portion is typically greater than the length of the extension portion. The length L1 of the tab portion 68 as shown in FIG. 3C is generally from about 0.75 to about 3 times greater than the length L2 of the extension portion 70. The length L1 of the tab portion 68 is generally from about 1 to about 3 times greater than the length L2 of the extension portion 70. The length L1 of the tab portion 68 is generally from about 1 to about 2 times greater than the length L2 of the extension portion 70.

The polymeric closure 10 as shown in FIG. 1A includes a plurality of knurls 46 formed on the annular skirt portion 14. The plurality of knurls 46 assists the user in gripping the polymeric closure 10 during the opening and closing of the closure from the container. It is contemplated that the polymeric closure may not include knurls in other embodiments.

One non-limiting example of a polymeric closure and a container forming a package is shown and discussed in conjunction with FIGS. 2-3C. Specifically, the polymeric closure 10 may be used with a container 100 to form the package 200 of FIGS. 2-3C. A portion of the container 100 is best shown in FIG. 3B and includes a neck portion 102 that defines an opening. The neck portion 102 of the container 100 includes an external thread formation 104 and the A-collar 110. The external thread formation 104 engages with the corresponding internal thread formation 30 to seal the package 200. As discussed above, the A-collar 110 assists in positioning the tamper-evident band 18 when the closure 10 is unthreaded from the neck 102 of the container 108 by the breaking of the frangible connection 50. The container 100 includes a sidewall 112 and a bottom 114 in which the sidewall 112 encompasses and is integrally connected with the bottom 114.

The external thread formation in one embodiment includes a first finish lead and a second finish lead. The first finish lead begins near the open end of the container and extends in a helical fashion to a second position that is closer to the closed end of the container. Similarly, the second finish lead starts closer to the open end of the container and extends in a helical fashion to a second position that is closer to the closed end of the container. Each of the first and second finish leads is continuous. The first positions of the first and second finish leads are located roughly 180 degrees apart from each other and, thus, begin on opposing sides of the neck of the container. When opening the container, the first closure lead is desirably in contact with the first finish lead and the second closure lead is desirably in contact with the second finish lead. It is contemplated that the external thread formation of the container may have discontinuous leads.

It is contemplated that the external thread formation of the container may be different than that disclosed with respect to the container 100. The external thread formation of the container may include continuous or discontinuous thread segments, and may include single or multiple threads. One non-limiting example of an external thread formation of the container is a helical thread formation.

The closures of the present invention comprise at least one polymeric material. The polymeric material is typically an olefin (e.g., polyethylene (PE), polypropylene (PP)), PET or blends thereof. Non-limiting examples of polyethylenes that may be used are high density polyethylene (HDPE), low density polyethylene (LDPE), linear low density polyethylene (LLDPE) and metallocene-catalyzed LLDPE (mLLDPE).

The closures of the present invention may include an oxygen-scavenger material. This oxygen-scavenger material may be distributed within the closure or may be a separate layer. The oxygen-scavenger material may be any material that assists in removing oxygen within the container, while having little or no effect on the contents within the container.

Alternatively, or in addition to, the closures may include an oxygen-barrier material. The oxygen-barrier material may be added as a separate layer or may be integrated within the closure itself. The oxygen-barrier materials assist in preventing or inhibiting oxygen from entering the container through the closure. These materials may include, but are not limited to, ethylene vinyl alcohol (EVOH). It is contemplated that other oxygen-barrier materials may be used in the closure.

The closures are typically formed by processes such as injection or compression molding, extrusion or the combination thereof.

The containers described above are typically made of polymeric material. One non-limiting example of a material to be used in forming a polymeric container is polyethylene terephthalate (PET), polypropylene (PP) or blends using the same. It is contemplated that the container may be formed of other polymeric or copolymer materials. It is also contemplated that the container may be formed of glass. The container typically has an encapsulated oxygen-barrier layer or oxygen barrier material incorporated therein.

To open the container and gain access to the product therein, the closure (e.g., closure 10) is unthreaded by turning the closure with respect to the container in one embodiment.

The polymeric closures are desirable in both low-temperature and high-temperature applications. The polymeric closures may be used in low-temperature applications such as an ambient or a cold fill. These applications include water, sports drinks, aseptic applications such as dairy products, and pressurized products such as carbonated soft drinks. It is contemplated that other low-temperature applications may be used with the polymeric closures of the present invention.

The polymeric closures may be exposed to high-temperature applications such as hot-fill, pasteurization, and retort applications. A hot fill application is generally performed at temperatures around 185° F., while a hot-fill with pasteurization is generally performed at temperatures around 205° F. Retort applications are typically done at temperatures greater than 250° F. It is contemplated that the polymeric closures of the present invention can be used in other high-temperature applications.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

Although the disclosed embodiments have been illustrated and described with respect to one or more implementations, equivalent alterations and modifications will occur or be known to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

While various embodiments of the present invention have been described above, it should be understood that they have been presented by way of example only, and not limitation. Numerous changes to the disclosed embodiments can be made in accordance with the disclosure herein, without departing from the spirit or scope of the invention. Thus, the breadth and scope of the present invention should not be limited by any of the above described embodiments. Rather, the scope of the invention should be defined in accordance with the following claims and their equivalents.

What is claimed is:

1. A closure comprising:

a first closure portion including:

a polymeric top wall portion;

a polymeric annular skirt portion depending from the polymeric top wall portion, the annular skirt portion including an exterior surface and an interior surface, the interior surface of the annular skirt portion including an internal thread formation for mating engagement with an external thread formation of a container; and a second closure portion including:

a polymeric tamper-evident band depending from and being at least partially detachably connected to the polymeric annular skirt portion by a frangible connection, the polymeric tamper-evident band including a first portion and a second portion connected via a bending area, the first portion having a flared end in which the thickness of the flared end is at least 1.25 times greater than the thickness of a directly adjacent section of the first portion, the second portion extending generally upwardly from the bending area towards the polymeric top wall portion and being located inwardly from the first portion of the polymeric tamper-evident band, the second portion of the tamper-evident band including a tab portion and an extension portion, the tab portion including an upper section and a lower section, the upper section of the tab portion being located closer to the extension portion than the bending area, the lower section of the tab portion being located closer to the bending area than the extension portion, the extension portion being located further from the bending area than the tab portion, the average thickness of the tab portion being greater than the average thickness of the extension portion, the extension portion extending continuously around an entire inner circumference of the closure, wherein the flared end of the first portion extends inwardly so as to form a gap between the first portion and the second portion of the polymeric tamper-evident band in a functional position after threading with a container, the flared end being located opposite of the polymeric top wall portion and next to the bending point.

2. The closure of claim 1, wherein the thickness of the flared end is at least 1.5 times greater than the thickness of the directly adjacent section of the first portion.

3. The closure of claim 2, wherein the thickness of the flared end is at least 1.75 times greater than the thickness of the directly adjacent section of the first portion.

4. The closure of claim 1, wherein the thickness of the flared end is from about 1.25 to about 2.5 times greater than the thickness of the directly adjacent section of the first portion.

5. The closure of claim 4, wherein the thickness of the flared end is from about 1.5 to about 2.5 times greater than the thickness of the directly adjacent section of the first portion.

6. The closure of claim 1, wherein the extension portion is spaced entirely from the interior surface of the polymeric annular skirt portion before mating engagement with the container.

7. The closure of claim 1, wherein the tab portion and the extension portion are substantially vertical after fitment with a container.

8. The closure of claim 1, wherein the extension portion of the tamper-evident band is at an angle of from 5 to about 30 degrees inwardly relative to an axis extending to the polymeric top wall portion before mating engagement with the container.

9. The closure of claim 8, wherein the extension portion of the tamper-evident band is at an angle of from about 10 to about 25 degrees inwardly relative to an axis extending to the polymeric top wall portion before mating engagement with the container.

10. The closure of claim 9, wherein the extension portion of the tamper-evident band is at an angle of from 10 to about 20 degrees inwardly relative to an axis extending to the polymeric top wall portion before mating engagement with the container.

11. The closure of claim 1, wherein the average thickness of the tab portion is from about 2 to about 8 times greater than the average thickness of the extension portion.

12. The closure of claim 11, wherein the average thickness of the tab portion is from about 3 to about 6 times greater than the average thickness of the extension portion.

13. The closure of claim 1, wherein the length of the tab portion is from about 0.75 to about 3 times greater than the length of the extension portion.

14. The closure of claim 13, wherein the length of the tab portion is from about 1 to about 2 times greater than the length of the extension portion.

15. The closure of claim 1, wherein the closure is a one-piece closure.

16. A package comprising:

a container having a neck portion defining an opening, the container having an external thread formation on the neck portion; and a closure being configured for fitment to the neck portion of the container for closing the opening, the closure including a first closure portion and a second closure portion, the first closure portion including a polymeric top wall portion and a polymeric annular skirt portion depending from the polymeric top wall portion, the annular skirt portion including an exterior surface and an interior surface, the interior surface of the annular skirt portion including an internal thread formation for mating engagement with the external thread formation of the container, the second closure portion including a polymeric tamper-evident band depending from and being at least partially detachably connected to the polymeric annular skirt portion by a frangible connection, the polymeric tamper-evident band including a first portion and a second portion connected via a bending area, the first portion having a flared end in which the thickness of the flared end is at least 1.25 times greater than the thickness of a directly adjacent section of the first portion, the second portion extending generally upwardly from the bending area towards the polymeric top wall portion and being located inwardly from the first portion of the polymeric tamper-evident band, the second portion of the tamper-evident band including a tab portion and an extension portion, the tab portion including an upper section and a lower section, the upper section of the tab portion being located closer to the extension portion than the bending area, the lower section of the tab portion being located closer to the bending area than the extension portion, the extension portion being located further from the bending area than the tab portion, the average thickness of the tab portion being greater than the average thickness of the extension portion, the extension portion extending continuously around an entire inner circumference of the closure, wherein the flared end of the first portion extends inwardly so as to form a gap between the first portion and the second portion of the polymeric tamper-evident band in a functional position after threading with the container, the flared end being located opposite of the polymeric top wall portion and next to the bending point.

17. The package of claim 16, wherein the thickness of the flared end is at least 1.5 times greater than the thickness of the directly adjacent section of the first portion.

18. The package of claim 16, wherein the thickness of the flared end is from about 1.25 to about 2.5 times greater than the thickness of the directly adjacent section of the first portion.

19. The package of claim 18, wherein the thickness of the flared end is from about 1.5 to about 2.5 times greater than the thickness of the directly adjacent section of the first portion.

20. The package of claim 16, wherein the extension portion is spaced entirely from the interior surface of the polymeric annular skirt portion before mating engagement with the container.

* * * * *